United States Patent [19]

Kirma

[11] Patent Number: 4,653,842

[45] Date of Patent: Mar. 31, 1987

[54] BLOCK TYPE ELECTRICAL TERMINAL CONNECTOR

[75] Inventor: Safa Kirma, Wedel/Holstein, Fed. Rep. of Germany

[73] Assignee: Messerschmitt-Boelkow-Blohm Gesellschaft mit beschraenkter Haftung, Munich, Fed. Rep. of Germany

[21] Appl. No.: 791,789

[22] Filed: Oct. 28, 1985

[30] Foreign Application Priority Data

Nov. 12, 1984 [DE] Fed. Rep. of Germany ..... 3441297

[51] Int. Cl.[4] ..... H01R 9/00; H01R 11/22

[52] U.S. Cl. ..... 339/198 P; 339/198 S; 339/205; 339/258 P

[58] Field of Search ..... 339/19, 198 R, 198 P, 339/198 S, 204, 205, 217 S, 242, 258 P, 278 C

[56] References Cited

U.S. PATENT DOCUMENTS

| | | | |
|---|---|---|---|
| 3,383,643 | 5/1968 | Nava et al. | 339/205 |
| 3,383,644 | 5/1968 | Nava et al. | 339/242 X |
| 3,560,911 | 2/1971 | Zimmerman et al. | 339/278 C |
| 3,597,726 | 8/1971 | Appleton et al. | 339/198 P |
| 3,670,295 | 6/1972 | Ege et al. | 339/198 S |
| 3,697,935 | 10/1972 | Drapkin | 339/205 X |
| 4,558,919 | 12/1985 | Pohl | 339/198 S |

FOREIGN PATENT DOCUMENTS 1564408 4/1969 France .

OTHER PUBLICATIONS

NSA 937,910 (NSA=Normalization Sud Aviation).

*Primary Examiner*—E. Michael Combs
*Attorney, Agent, or Firm*—W. G. Fasse; D. H. Kane, Jr.

[57] ABSTRACT

A block type electrical terminal connector, especially for use in aircraft and spacecraft, has a pot-shaped housing of electrically insulating material permanently closed at its bottom and closable at its open top by a cover. A single piece contact bank for connecting groups of contact pins together, that is to the same potential, is made of a band of sheet metal, so that contact elements, contact pin retainers and arresting members form integral components of the single piece contact bank which is inserted into the open top of the housing and held in the housing by the cooperation of locking shoulders in the housing with the arresting members of the single piece contact bank, whereby the contact bank is retained in the housing even without the cover closing the housing. This construction substantially reduces the number of connector parts and simplifies the structure and assembly of the connector.

11 Claims, 13 Drawing Figures

BLOCK TYPE ELECTRICAL TERMINAL CONNECTOR

FIELD OF THE INVENTION

The invention relates to a block type electrical terminal connector, especially for use in aircraft and spacecraft. Such connectors have a housing of electrically insulating material and a contact arrangement held in place inside the housing for interconnecting groups of contact pins, for example, to the same potential. The contact arrangement includes a plurality of contact elements, whereby at least a portion of the contact arrangement is made of a sheet metal band. Such an arrangement also includes arresting members for securely locating the contact arrangement inside the housing as well as contact pin retainers for holding contact pins in the contact arrangement.

DESCRIPTION OF THE PRIOR ART

A known terminal connector or distributor of this type is disclosed in U.S. Pat. No. 3,597,726 (Appleton et al) showing a terminal block connector for electrically interconnecting at least two contact pins by means of a contact bushing arrangement held in place in an electrically insulating housing. The bushing arrangement includes a pair of stamped contact elements serving solely for the purpose of electrical contacts. Each contact has at its lower end a bottom section which is interconnected with the respective bottom section of the other contact element by an integral strip or land. Thus, the contact arrangement has a side view of U-shaped configuration and each contact has a sleeve type, concave, cylindrical contact surface for contacting the contact pin to a total angle of up to 180°. In this arrangement two contact surfaces face each other to form a contact bushing surrounded by a cylindrical spring for pressing the contact members forming the bushing toward each other for receiving and holding a contact pin inserted into the housing.

Such a connector or distributor may correspond to the standard requirements expressed, for example, in NSA Sheet No. 937901. (NSA=Normalization Sud Aviation). According to this standardization the connector housing comprises sealing elements which bear rigidly against the cables to be inserted into the housing. The respective contact pins are provided with a radially outwardly extending flange which serves for locking or arresting the contact pin inside the connector or distributor. As a result, the pins can be inserted into the housing only with the aid of a tool and their removal also requires a special tool. Such connectors also comprise contact pin retainers which cooperate with the radially outwardly extending flange of a contact pin for keeping the contact pin in the housing. In the connector according to U.S. Pat. No. 3,597,726 the contact pin retainers are made of elastically yielding sheet metal as components which are separated from the contact bushings inside the housing. Thus, the contact pin retainers are inserted from the upper end into the main housing body in which they are held by an upper closure plate or cover which prevents an axial movement of the contact pin retainers. On the other hand, the contact bushings themselves are inserted from the open bottom into the main body of the housing and are also held in place by a bottom plate. Both plates, the cover plate and the bottom plate, are secured to the housing by an adhesive bonding.

French Patent Publication No. 1,564,408 discloses a similar block type connector wherein the contact inserts made of sheet metal simultaneously form bridges between adjacent contact bushings. These bushings also comprise the required contact pin retainers and the bushings are inserted through the open bottom of the connector housing. Form pieces of silicone rubber are inserted between contact groups connected to different potentials to assure the required safety against sparking or corona discharge. The housing disclosed in French Patent No. 1,564,408 is closed at its top by an upper plate shaped to conform to the top portion of the housing and provided with bores for the contact pins passing through the upper plate forming the cover. The bottom of the housing is closed by a bottom plate which is secured to the open housing bottom by an adhesive bonding after the contact bushings and the silicon rubber form pieces have been inserted. These form pieces are specially shaped for each connector type, whereby the allocation of the individual bushings to the different potentials is determined. Thus, the respective form piece between the bushings connected to the same potential always form a channel for the respective connecting bridge and the form piece between bushings connected to different potentials always forms a spark or corona preventing barrier. The required sealing effect of the form piece is accomplished by a pressure deformation of the form piece made of silicone rubber.

Summarizing, it is to be noted that all prior art connectors or distributors of this type have several disadvantages. First, the required number of connector components is substantial, whereby the construction becomes complicated. Due to the need for accommodating a substantial number of components, the dimensions of prior art connectors are relatively large and the result is a relatively substantial weight. Yet another disadvantage of these prior art connectors is seen in that the adhesive bond between the housing on the one hand and the top cover plate and the bottom cover on the other hand are liable to fail, especially under varying temperature and vibration operating conditions. Further, each of these connector types is capable of cooperating only with one type of contact pin.

OBJECTS OF THE INVENTION

In view of the above it is the aim of the invention to achieve the following objects singly or in combination:

to simplify the entire construction and to reduce the number of components of such connectors so that their dimensions and weight may be reduced;

to construct such connectors in a way that adhesive bonding for the assembly of the housing is minimized; and to construct the contact bushings in such a way that they can cooperate with at least two different types of contact pins.

SUMMARY OF THE INVENTION

The above objectives have been achieved according to the invention in a block type electrical terminal connector or distributor which is characterized in that its housing has a pot-shaped configuration, that the contact bushings are formed as a single piece contact bank in which the contact pin retainers, the contact elements, and the arresting members all form integral components of the single piece contact bank which is inserted into the housing through an open top of the housing which is permanently closed at its bottom. These single piece contact banks are held in the housing by a snap-in connection between locking shoulders of the housing and the integral arresting members.

These structural features according to the invention have the advantage that the housing can be formed as a pot shape which does not require any bottom closure and that its top portion merely leaves a mounting opening while all its other sides are completely closed. Thus, separate housing components such as a bottom plate and separate form pieces for insulating contact bushings connected to different potentials from each other are obviated. The connector according to the invention also has a good electrical conductivity between the internal contact bushings and its dimensions are substantially smaller than the dimensions of corresponding prior art connectors having the same number of contact pin receiving bushings. Yet another important advantage is seen in that the present contact bushings are capable of cooperating with two different types of contact pins. Thus, the present connectors may be used for simultaneously accommodating two different types of connector pins, even if these pins are taken from different standardized plug-in connector systems.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
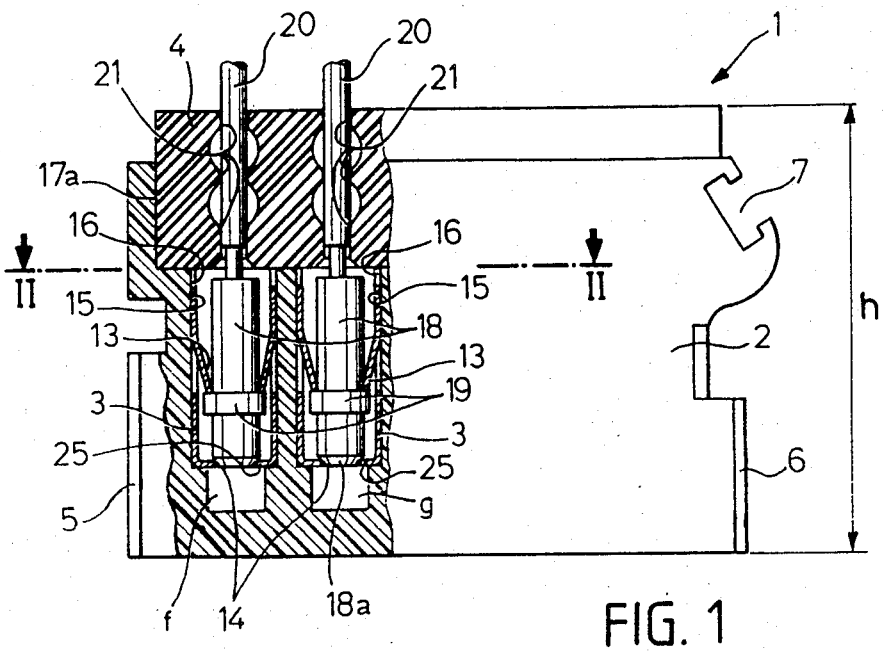
FIG. 1 is an elevational side view partially in section through a connector according to the invention.
Figure 2:
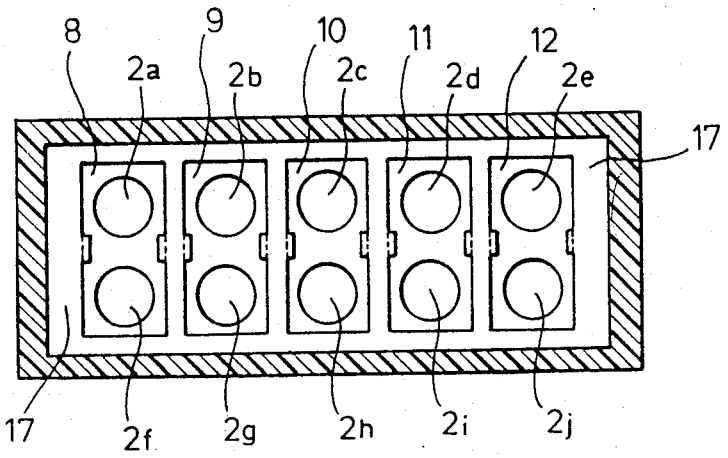
FIG. 2 is a sectional view along section line II—II in FIG. 1.

FIGS. 1 and 2 illustrate a connector 1 comprising a housing 2 of insulating material having a pot-shape with a permanently closed bottom and an accessible top portion for the insertion of several single piece contact banks 3. The top of the housing is closable by a sealing cushion 4 made of a rubber elastic material provided with sealed holes through which the electrical conductors 20 extend.

The housing 2 is made of synthetic material and the lower portion of the housing is provided with lateral projections 5 and 6 for the insertion into a support rail as is conventional. The housing 2 further comprises a lateral cross groove 7 into which an identifying plate or the like may be inserted. Inside the housing 2 there are provided ten pin chambers **2*a*, 2*b* . . . to 2*j*, the arrangement of which is best seen in FIG. 2. FIG. 2 shows a sectional view in the plane forming an interface between the housing 2 and the sealing cushion 4. As best seen in FIG. 2, chambers 2*a* and 2*f* are interconnected in their upper zone by a contact chamber 8. Similarly, chambers 2*b* and 2*g* are connected by a contact chamber 9. The same holds true for the contact chamber 10 connecting the pin chambers 2*c* and 2*h* in their upper region and the contact chamber 11 interconnecting the pin chambers 2*d* and 2*i* in their upper zone. Contact chamber 12 connects pins chambers 2*e* and 2*j*** in their upper zone.

The U-shaped single piece contact banks 3 are manufactured of a suitable sheet metal band employing conventional stamping techniques, whereby such single piece contact banks may be produced in a continuous manner. After all stamping and bending steps have been performed, the continuous length of contact banks may be cut into pieces of the required length. For example, each length of single piece contact bank may comprise two bushings for receiving two contact pins, whereby each bushing comprises two contact pin retainers facing each other and one opening in the yoke or bottom of the single piece contact bank below each bushing.

The single piece contact banks 3 are installed in the housing by simply pushing the respective bank from above into the chambers 8 to 12, whereby the upper edges 15 of the contact banks 3 function as integral arresting members cooperating with locking shoulders 16 arranged near the top edge of the housing proper. Once the integral arresting members or edges 15 are engaged behind, or rather below the shoulders 16, the single piece contact banks 3 are safely held inside the housing 2. The last step is the attachment of the sealing cushion 4 which may be adhesively bonded to the surfaces 17 and **17*a*** of the housing. Thus, the connector is completed.

The connector according to the invention thus comprises only three different components, namely the housing 2, the single piece contact banks 3, and the sealing cushion 4. This type of construction makes it possible to provide the housing with an overall height h smaller than the lowest prior art connectors of this type. As shown in FIG. 1 contact pin chambers are provided in the lower portion of the connector and contact bank. One conventional contact pin 18 already connected to its conductor 20 is inserted into each pin chamber f and g. These contact pins may correspond to the standardized pins disclosed in the above mentioned NSA Standard Sheet No. 937901. Each pin 18 is provided with a conical tip portion 18*a* and with a radially outwardly extending flange 19. The sealing cushing 4 comprises in its through hole, for example, three sealing lips 21 tightly contacting the outer surface of the insulated electrical conductors 20 for avoiding the entrance of moisture and dirt into the connector or distributor housing.

As the contact pin 80 is inserted, the contact pin retainers 13 are pressed radially outwardly, relative to the longitudinal axis of the contact pin 18, by the radially outwardly extending flange 19. When the flange 19 has passed the contact pin retainers, the latter spring back inwardly into a retaining position bearing against the flange 19 as shown in FIG. 1, whereby the pin 18 is locked or arrested against an unintended removal from the connector. However, an intended removal of the pin 18 is still possible at any time by means of a simple tool which spreads the retainers 13. The single piece contact bank 3 comprises for each pin 18 two tongue shaped contact elements 25 forming an integral part of the contact bank 3. The free ends of the contact elements 25 bear with a predetermined pressure force against the conical surface 18*a* of the contact pin 18, whereby the required electrical contact is established at both locations. The contact tongues 25 are biased axially upwardly due to their inherent spring characteristic, so that the upper surface of the flange 19 is pushed against the free ends of the contact pin retainers 13 also forming an integral component of the single piece contact bank 3. As a result, the tongues 13 also form an electrical contact between the bank 3 and the pin 18. Since the pin retainers 13 also have a certain spring characteristic they bear against the pin 18 radially inwardly with a certain pressure force, thereby providing two further contact points, whereby a total of six electrical contact locations are established between the pin 18 and the contact bank 3. It should be noted that the free ends of the tongue type elements 13 and 25 are shaped to the respective local surface curvature of the contact pin 18, whereby the resulting contact surface is as large as possible and any precious metal coating on the surface of the contact pins cannot be damaged by sharp edges of the sheet metal elements.

Figure 3:
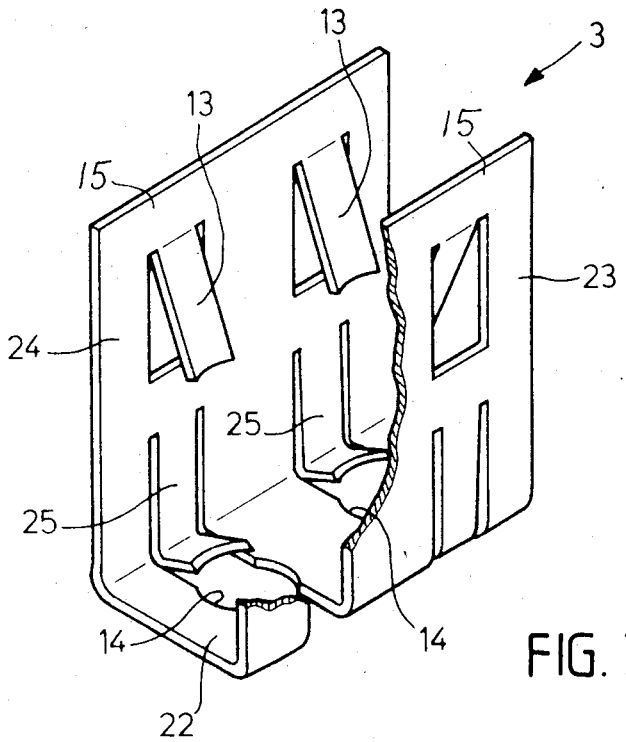
FIG. 3 is a perspective view of a single piece contact bank made of sheet metal according to the invention.

FIG. 3 shows a perspective view of a single piece sheet metal contact bank 3 having a U-shaped cross-sectional configuration corresponding to the bank 3 shown in FIG. 1. The bank 3 comprises two leg portions 23 and 24 interconnected by a yoke portion 22 provided with two openings 14 adjacent to the contact elements 25. The leg portions 23 and 24 are each provided with two inwardly projecting, stamped pin retainers 13. The free ends of the tongue typed, curved retainers 13 point toward the yoke 22. The openings 14 are partially formed by the free ends of the tongue type contact elements 25 arranged to face each other across the respective opening 14. The upper ends of the contact elements begin just below the lower ends of the retainers 13. Due to the angular shape of the lower end of the contacts 25, the bias force against the respective pin is directed substantially axially upwardly, whereby, in combination with the elastic characteristics of the sheet metal good contact forces are established between an inserted pin 18 and the respective contacte elements 25. These contact forces are maintained at a predetermined level as long as a pin is inserted and held in place by the retainers 13.

Figure 4:
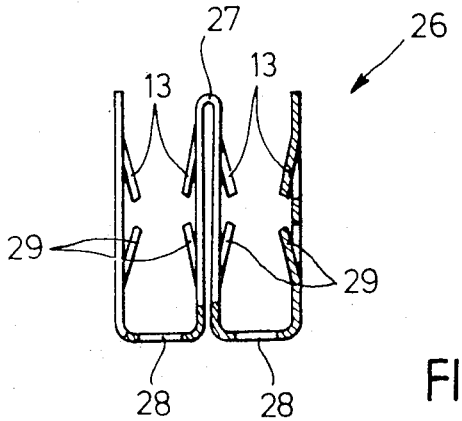
FIG. 4 is an end view, partially in section, of another single piece contact bank according to the invention comprising a double U-shaped configuration.

FIG. 4 shows a single piece contact bank 26 having a double-U-shaped cross-sectional configuration which may also be manufactured at any desired length, depending on the available sheet material band. The required individual length is then cut from the premanufactured length. A length corresponding the bank 3 shown in FIG. 3, would provide four pin receptacles, but as mentioned, any desired length may be cut. The bank 26 has two outer side legs and two inner legs which are interconnected through a bridge 27 so that again a single piece bank results. The pin retainers 13 in the bank of FIG. 4 are the same as in FIG. 3. However, the contact elements 29 in FIG. 4 differ from the contact elements 25 in that the contact elements 29 reach upwardly in the same manner, but inverted, as the retainers 13 reach downwardly. Thus, the contact elements 29 will press radially inwardly against an inserted pin and simultaneously bear axially against the flange 19. Since the retainers 13 and the contact elements 29 point in opposite axial directions, a pin inserted into the so formed pin receptacle is arrested against movement in both axial directions. Incidentally, the downwardly pointing free ends of the retainer 13 are spaced from the upwardly pointing free ends of the contact elements 29 to such an extent that the axial thickness of the flange 19 is properly received between the just mentioned free ends of the retainers 13 and the contact elements 29.

Figure 5:
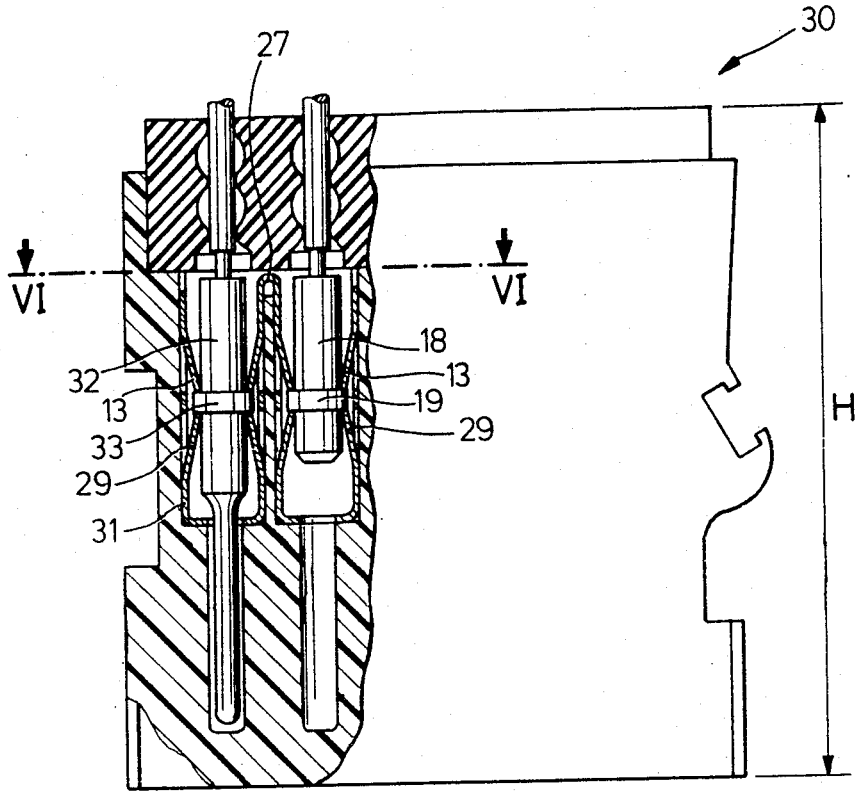
FIG. 5 shows a connector similar to that of FIG. 1 employing a double single piece contact bank as shown in FIG. 4 and capable of accommodating two different types of contact pins.
Figure 6:
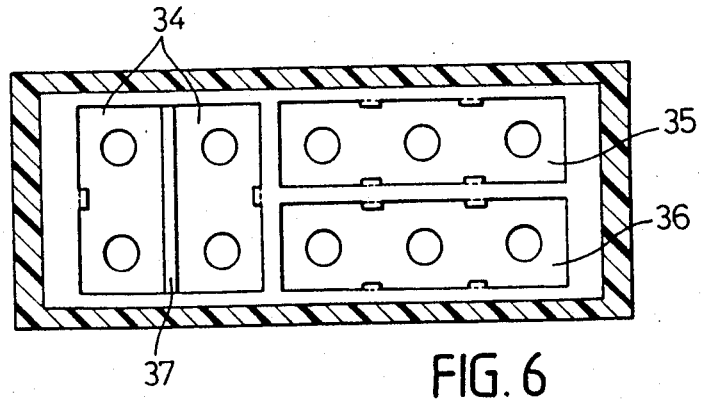
FIG. 6 is a sectional view along section line VI—VI in FIG. 5.

FIGS. 5 and 6 illustrate a connector 30 using a single piece contact bank 31 having a double-U-cross-sectional configuration as shown in connection with the bank 26 of FIG. 4. In the right-hand part shown in section in FIG. 5, the bank 31 forms a receptacle for a contact pin 18 having a flange 19, whereas in the left portion of the bank 31 a different type of contact pin 32 is shown having a flange 33. Since both pins,although of different configuration, have the same dimensions in the flanges 19 and 33, the same contact bank is able to receive both types of pins 18, 32 due to the arrangement of the pin retainers 13 and the contact elements 29 according to the invention. This feature of the invention has several advantages, especially with regard to maintaining different pins in stock. The larger structural height H in FIG. 5, as compared to the structural height h in FIG. 1, is due to the axial length of the pin 32. In spite of this structural height H, the embodiment of FIG. 5 is not higher than the above mentioned connector according to NSA Sheet No. 937901 which can only accommodate pins as shown at 18.

FIG. 6 shows the contact chambers 34, 35, and 36 without contact banks inserted. Thus, the chamber 34 which is subdivided by a wall 37 provides space for one double-U-shaped contact bank 31 which in turn provides four receptacles for four pins to be connected to the same potential. The chambers 35 and 36 each provide space for one contact bank having a single U-shaped cross-sectional configuration and providing three pin receptacles, whereby two groups of three pins each may be connected to different potentials. The further details of the connector illustrated in FIGS. 5 and 6 correspond substantially to the features of the connector 1 according to FIG. 1.

The connectors described below with reference to FIGS. 7 to 11 comprise differently configured contact banks each of which, however, is constructed as a single piece contact bank in which the contact elements, the pin retainers, and the arresting members or edges form integral components of the single piece contact bank.

Figure 7:
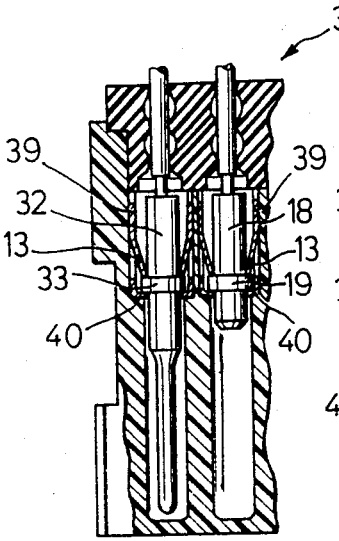
FIG. 7 shows a sectional view through a connector using two separate, substantially U-shaped single piece contact banks of identical construction, yet capable of accommodating different types of contact pins.

FIG. 7 shows a portion of a connector in section for accommodating different contact pins 18 and 32 in a connector 38 having two separate U-shaped contact banks 39 including pin retainers 13 and contact elements 40. As in the bank 3 of FIG. 1, the contact elements 40 of FIG. 7 are also located in the yoke portion of the U-shaped bank 39. However, in FIG. 7 the contacts 40 extend approximately radially so that the contact pressure force is also radially effective just below the flanges 19 and 33 of the contact pins 18 and 32.

Figure 8:
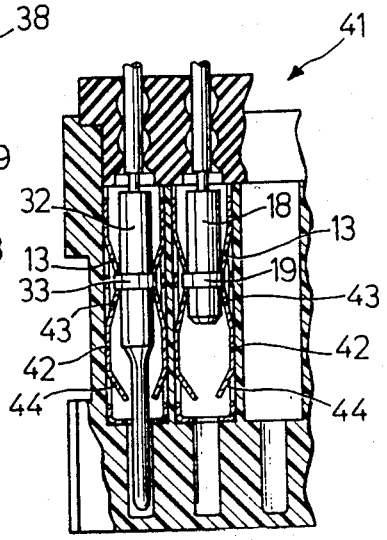
FIG. 8 is a sectional view similar to that of FIG. 7, but showing a modified version of single piece contact banks.

FIG. 8 shows a partial section through a connector 41 holding two U-shaped contact banks 42, each of which comprises as an integral single piece component two pin retainers 13, two contact elements 43, and two further contact elements 42 for each contact pin 18, 32. The connector or distributor 41 is also capable of accommodating two different types of contact pins. In FIG. 8 the contact elements 44 are arranged so that for the longer type of contact pin two additional contacts may be provided by appropriately bending the contact elements 44 inwardly, for example.

Figure 9:
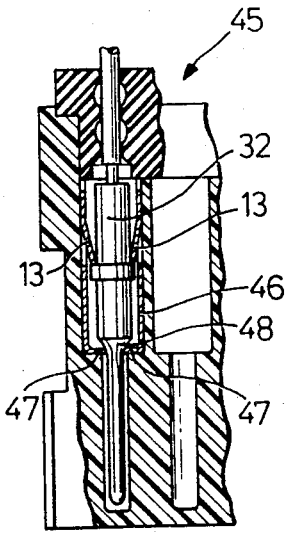
FIG. 9 is a sectional view similar to FIG. 7 showing a further modified single piece contact bank.

FIG. 9 shows a connector 45 in which the U-shaped single piece contact bank 46 provides for each contact pin 32 two pin retainers 13 and two contact elements 47, whereby the latter are so located that they cooperate or contact a conical section 48 of the pin 32 with a predetermined contacting force. Due to the conical shape of the section 48, the contacting force has an axially upwardly directed component in addition to the radial component so that a total of six contact locations are provided for each pin 32 just as in FIG. 1.

Figure 10:
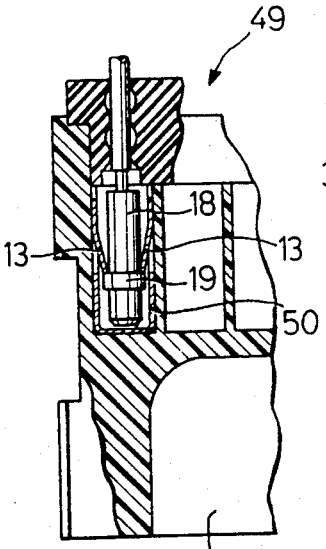
FIG. 10 is a sectional view through a housing and a single piece contact bank which has a very short axial length.

FIG. 10 illustrates a connector 49 with two pin retainers 13 for each pin. The single piece contact bank 50 again has a U-shaped-cross-sectional configuration. However, the retainers 13 are used also as contact elements. The connector 49 is especially simple and is intended for use in connection with short type contact pins 18. As a result, the structural height may be especially small. However, in order to still provide the required ability to handle the connector, its housing may be provided with a hollow rib 51. If desired, the contact bank 50 may also be provided with contact elements of the type shown at 29 in FIG. 5 and reaching under the flange 19 of the pin 18. The connector 49 also has an exceptionall low weight.

Figure 11:
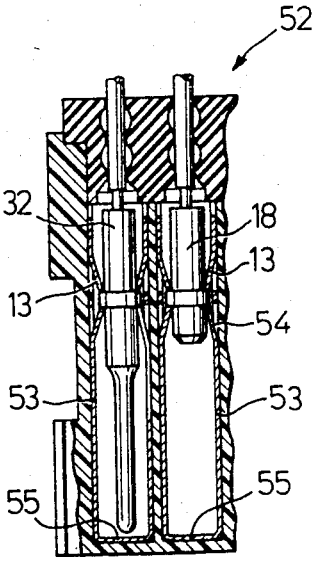
FIG. 11 is a sectional view illustrating yet another version of single piece contact banks capable of accommodating contact pins of different length.

FIG. 11 illustrates a connector 52 constructed for accommodating two different pins 18 and 32 cooperating with the same type of single piece contact bank 53 having a U-shaped configuration. Each bank 53 has for each pin 18, 32 two retainers 13 and two contact elements 54. The connecting yoke 52 reaches substantially to the bottom of the connector housing so that the available cross-sectional area of conducting material is substantial. Accordingly, the electrical connection between pins connected to the same potential is also substantial.

Figure 12:
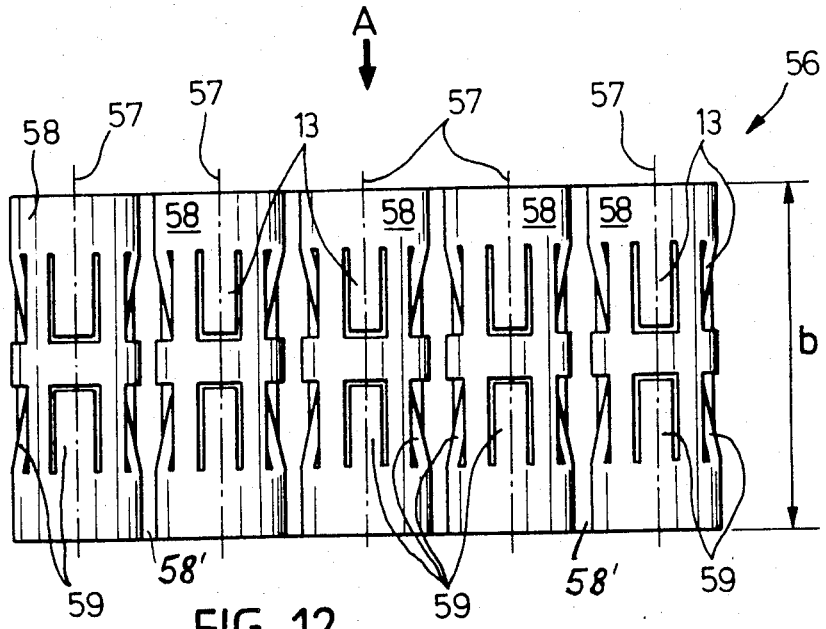
FIG. 12 shows a side view of a single piece contact bank made of sheet metal and differing from FIG. 3.
Figure 13:
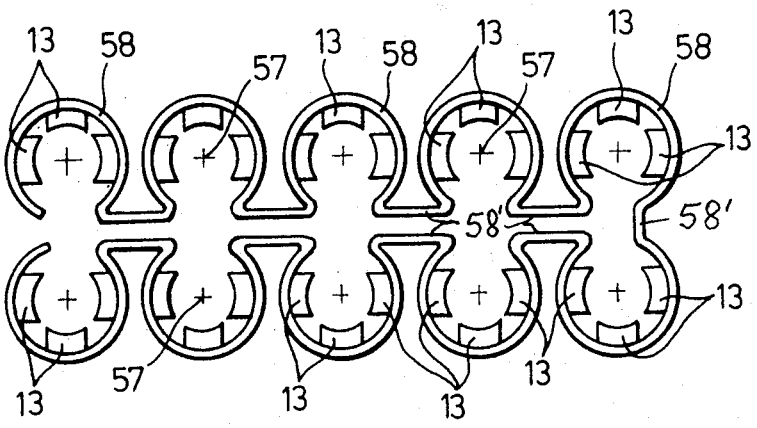
FIG. 13 is a top view in the direction of the arrow A in FIG. 12 showing the single piece contact bank forming ten connector bushings all electrically interconnected.

Although FIGS. 7 to 11 show only single U-shaped contact banks 39, 42, 46, 50, and 53, rather than double banks, it is quite possible that double banks can also be used in these embodiments. Even the U-configuration is not essential since bushing type single piece connector banks may also be used as illustrated in FIGS. 12 and 13. Incidentally, in FIGS. 7 to 11 the upper edges of each of the contact banks are locked against a housing shoulder 16 as shown in FIG. 1.

FIGS. 12 and 13 show a single piece contact bank 56 formed from a continuous length of sheet metal band having a width b. A plurality of bushing type pin receptacles 58 are formed, each of which has a central longitudinal axis 57. As shown, each receptacle 58 has three pin retainers 13 and three contact elements 59. The wall of the bushing forming the receptacles 58 is so shaped that the angular range is as large as possible. The cylindrical portions are interconnected by lands 58' so that a single piece bank results. Due to the symmetrical arrangement of the retainers 13 in the upper portion and the contact elements 59 in the lower portion, it is not necessary to pay attention in which direction the bank 56 is inserted into its housing. In other words, it does not matter in which direction the bank 56 is inserted into the housing. The bank 56 is suitable for a connector in which ten pins are connected to the same potential. However, again the bank 56 may be shorter or longer and different potentials may also be accommodated in the same connector as described above.

Although the invention has been described with reference to specific example embodiments, it will be appreciated, that it is intended to cover all modifications and equivalents within the scope of the appended claims.

What I claim is:

1. An electrical block type terminal connector, comprising a single piece housing of electrically insulating material having side wall means and a bottom forming a pot shaped configuration enclosing a cavity permanently closed by said bottom and having an initially open top, said side wall means having locking shoulder means (16) inside said cavity away from and facing about toward said bottom, sheet metal contact means in said cavity, said sheet metal contact means including contact pin retainers for holding contact pins in place in said sheet metal contact means, said sheet metal contact means comprising a single piece contact bank for connecting groups of contact pins together, said single piece contact bank comprising a U-shaped sectional configuration with a yoke section and two legs interconnected by said yoke section at one end and free at the opposite ends, said legs being initially biased away from each other and having formed therein said contact pin retainers and contact elements for contacting contact pins, said free opposite leg ends forming arresting members as integral components of said single piece contact bank, said arresting members engaging said locking shoulder means (16) when said contact bank is fully inserted into said cavity in said housing through said open top, whereby said contact bank is held in said housing by a snap-in connection between said locking shoulders of said housing and said integral arresting members of said biased legs of said single piece contact bank.

2. The connector of claim 1, wherein said integral contact elements are tongue shaped and arranged for bearing against a respective contact pin with a force which is effective approximately in a radial direction relative to a longitudinal contact pin axis.

3. The connector of claim 1, wherein said integral contact elements are tongue shaped and are arranged in pairs, so that two tongue shaped contact elements of a pair face each other in a direction extending perpendicularly across a longitudinal contact pin axis.

4. The connector of claim 1, wherein said single piece contact bank has a yoke section, and wherein said integral contact elements are arranged in said yoke section, said integral contact elements having free ends for contacting a respective contact pin in a direction extending approximately axially relative to a longitudinal contact pin axis.

5. The connector of claim 1, wherein said integral contact pin retainers are tongue shaped and are arranged for bearing against a respective contact pin with a force which is effective approximately in a radial direction relative to a longitudinal contact pin axis.

6. The connector of claim 1, wherein said integral contact pin retainers are tongue shaped to function simultaneously as contact elements and are arranged for bearing against a respective contact pin with a predetermined force.

7. The connector of claim 1, wherein said single piece contact bank has a double U-shaped cross-sectional configuration with two outer leg sections, one double inner leg section and two yoke sections each interconnecting an outer leg section with the double inner leg section.

8. The connector of claim 1, wherein said integral contact elements comprise a tongue shaped configuration which is an integral part of the respective single piece contact bank made of a band of sheet metal forming a plurality of sleeve-type zones interconnected by sheet metal bands to form said single piece contact bank, said integral contact pin retainers also having a tongue shaped configuration so projecting from said sheet metal band that said contact pin retainers bear against a respective contact pin with a predetermined approximately radially inwardly directed force relative to a longitudinal contact pin axis.

9. The connector of claim 1, wherein said single piece contact bank has a configuration adapted for cooperation with different types of contact pins.

10. The connector element of claim 1, wherein said single piece contact bank is made of a sheet metal band from which said integral contact elements and said integral contact pin retainers are stamped and bent out as tongues having free ends spring biased radially inwardly relative to a longitudinal contact pin axis, said integral contact elements and said integral contact pin retainers being arranged so that the free ends of an integral contact element and of an integral contact pin retainer point substantially axially but in opposite axial directions relative to said contact pin axis, and an axial spacing between said free ends for cooperation with a radially outwardly extending flange of an inserted contact pin for arresting the contact pin in both axial directions.

11. The connector element of claim 10, wherein said integral contact elements and said integral contact pin retainers are arranged so that a contact element and a contact pin retainer forming a pair, are axially aligned and axially spaced from each other for said arresting.

* * * * *